US010465975B2

(12) United States Patent
Hwang et al.

(10) Patent No.: US 10,465,975 B2
(45) **Date of Patent: *Nov. 5, 2019**

(54) REFRIGERATOR

(71) Applicant: LG Electronics Inc., Seoul (KR)

(72) Inventors: Jungyeon Hwang, Seoul (KR); Jiyoung Park, Seoul (KR); Hyunjung Kim, Seoul (KR); Eunjoo Lee, Seoul (KR); Kyukwan Choi, Seoul (KR); Boram Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 602 days.

This patent is subject to a terminal disclaimer.

(21) Appl. No.: 14/468,657

(22) Filed: Aug. 26, 2014

(65) Prior Publication Data

US 2015/0059399 A1 Mar. 5, 2015

(30) Foreign Application Priority Data

Sep. 3, 2013 (KR) ..... 10-2013-0105264
Sep. 5, 2013 (KR) ..... 10-2013-0106477

(51) Int. Cl.
*F25D 11/02* (2006.01)
*F25D 23/00* (2006.01)
(Continued)

(52) U.S. Cl.
CPC ..... *F25D 23/068* (2013.01); *F25D 17/065* (2013.01); *F25D 25/025* (2013.01);
(Continued)

(58) Field of Classification Search
CPC ..... F25D 11/02; F25D 17/068; F25D 23/025; F25D 23/069; F25D 23/02; F25D 23/04; A47B 2088/0011
(Continued)

(56) References Cited

U.S. PATENT DOCUMENTS 2,898,173 A * 8/1959 Squire ..... F25D 23/04 16/358
3,077,749 A * 2/1963 Jung ..... F25D 17/065 312/236
(Continued)

FOREIGN PATENT DOCUMENTS

EP 2119987 * 11/2009 ..... F25D 11/02
KR 1020070055904 5/2007
KR 1020110067954 6/2011

*Primary Examiner* — Christopher R Zerphey
(74) *Attorney, Agent, or Firm* — Fish & Richardson P.C.

(57) ABSTRACT

A refrigerator includes a cabinet defining a first storage compartment and a second storage compartment that is positioned vertically below the first storage compartment, a first mullion that partitions the first storage compartment from the second storage compartment, an access cover configured to open or close the access hole, a reception drawer configured to be received into the second storage compartment and including a reception door configured to open and close the second storage compartment and a reception box provided in a rear surface of the reception door, and a cover member configured to cover at least a portion of a top surface of the reception box. The first mullion defines an access hole that allows fluid communication between the first storage compartment and the second storage compartment.

19 Claims, 6 Drawing Sheets

(51) Int. Cl.

| | |
|---|---|
| ***F25D 23/02*** | (2006.01) |
| ***F25D 23/06*** | (2006.01) |
| ***F25D 25/02*** | (2006.01) |
| ***F25D 17/06*** | (2006.01) |
| *F25D 17/04* | (2006.01) |

(52) U.S. Cl.
CPC ..... *F25D 17/045* (2013.01); *F25D 23/069* (2013.01); *F25D 2317/061* (2013.01); *F25D 2317/0667* (2013.01)

(58) Field of Classification Search
USPC ..... 312/407.1
See application file for complete search history.

(56) References Cited

U.S. PATENT DOCUMENTS 5,551,252 A * 9/1996 Lee ..... F25D 17/065 62/414
6,250,092 B1 * 6/2001 Lanz ..... F25D 17/045 236/49.5
9,228,776 B2 * 1/2016 Burke ..... F25D 23/065
9,429,351 B2 * 8/2016 Porter ..... F25D 17/045
2006/0016210 A1 * 1/2006 Lee ..... F25D 17/045 62/408
2007/0163290 A1 * 7/2007 Shin ..... F25D 17/045 62/408
2007/0169504 A1 * 7/2007 Vinocur ..... F16K 3/312 62/408
2008/0307807 A1 * 12/2008 Graff ..... F25D 17/045 62/186
2011/0083464 A1 * 4/2011 Kettles ..... F25D 23/025 62/441
2012/0060544 A1 * 3/2012 Lee ..... F25D 23/02 62/440
2013/0098078 A1 * 4/2013 Contreras Lafaire ... F25D 21/06 62/82
2013/0127322 A1 * 5/2013 Seo ..... F25D 23/069 312/404
2015/0115790 A1 * 4/2015 Ogg ..... F25D 23/069 312/404

* cited by examiner

REFRIGERATOR

CROSS-REFERENCE TO RELATED APPLICATIONS

The present application claims the benefits of priority to Korean Patent Application No. 10-2013-0105264 filed on Sep. 3, 2013, and 10-2013-0106477 filed on Sep. 5, 2013, which are herein incorporated by reference in their entirety.

FIELD

The present disclosure relates to a refrigerator.

BACKGROUND

Refrigerators are home appliances for storing foods at a low temperature. In recent years, demands of refrigerators having large capacity and low power consumption are increasing.

As such a refrigerator increases in capacity, the refrigerator may increases in door size. Thus, the loss of cool air occurring when a refrigerator door is opened and power consumption due to the loss of the cool air may increase.

SUMMARY

According to one aspect, a refrigerator includes a cabinet defining a first storage compartment and a second storage compartment that is positioned vertically below the first storage compartment, a first mullion that partitions the first storage compartment from the second storage compartment, an access cover configured to open or close the access hole, a reception drawer configured to be received into the second storage compartment and including a reception door configured to open and close the second storage compartment and a reception box provided in a rear surface of the reception door, and a cover member configured to cover at least a portion of a top surface of the reception box. The first mullion defines an access hole that allows fluid communication between the first storage compartment and the second storage compartment.

Implementations of this aspect may include one or more of the following features. For example, the access hole may be defined at a position that is nearer to a front end of the mullion than a rear end of the mullion. The refrigerator may further include one or more storage boxes disposed on a top surface of the first mullion, wherein the one or more storage boxes may be positioned rearward of the access hole. The access cover may be configured to slide forward or backward to open or close the access hole, respectively. The mullion may include a cover accommodation groove configured to receive the access cover when the access cover slidably moves in a backward direction. The access cover may be configured to open or close the access hole by vertically rotating with respect to a rear end of the access cover. At least a portion of the access cover may be transparent.

A refrigerator according to this aspect may also include a first cooling chamber defined at a rear side of the second storage compartment and configured to supply cool air into the second storage compartment. The reception box may include an insulation wall that defines an exterior of the reception box, a refrigerating space defined inside the insulation wall, a freezing space defined inside the insulation wall, and a partition wall that partitions the refrigerating space from the freezing space. The reception box may be configured to, when the reception door is in a closed position, allow fluid communication between the freezing space and the first cooling chamber. The freezing space may be defined at a rear side of the refrigerating space. The access hole may be positioned to correspond to the refrigerating space of the reception box when the reception door is in the closed position. The cover member may be configured to cover a top surface of the freezing space of the reception box. The cover member may be slidably coupled to an upper end of the reception box. The cover member may be rotatably coupled to an upper end of a rear surface of the reception box. The insulation wall may include a first insulation wall defining the freezing space, and a second insulation wall defining the refrigerating space, wherein the first insulation wall may have a thickness greater than a thickness of the second insulation wall. The refrigerator may further include a first cool air grille that partitions the second storage compartment from the first cooling chamber, wherein a cool air discharge hole and a cooling air collection hole through which the cool air passes may respectively be defined in the first cooling grille. The reception drawer may be configured such that, when the reception door is in a fully closed position, a rear surface of the insulation wall defining the freezing space is in close contact the first cool air grille. A cool air discharge hole and a cool air collection hole may respectively be defined in the rear surface of the insulation wall. The cool air discharge hole and the cool air collection hole of the insulation wall may be in fluidic communication with the cool air discharge hole and the cool air collection hole of the first cool air grille, respectively. The refrigerator may further include a first evaporator and a first cooling fan that are disposed in the first cooling chamber. The refrigerator may further include a third storage compartment defined below the second storage compartment, a second mullion that partitions the second storage compartment from the third storage compartment, a second cooling chamber defined at a rear side of the third storage compartment, a second cool air grille that partitions the third storage compartment from the second cooling chamber, a reception member accommodated in the third storage compartment, and a second evaporator and a second cooling fan that are disposed in the second cooling chamber. The second mullion may define a communication hole at a position corresponding to a top surface of the second cooling chamber, the communication hole allowing fluidic communication between the first and second cooling chambers. Cool air in the second cooling chamber may be supplied into the first cooling chamber through the communication hole. The cool air supplied into the first cooling chamber may be supplied into the freezing space of the reception box through the first cool air grille. The first storage compartment may include a refrigerating compartment, and the third storage compartment may include a freezing compartment. The second storage compartment may include an additional refrigerating compartment or an additional freezing compartment.

The details of one or more implementations are set forth in the accompanying drawings and the description below. Other features will be apparent from the description and drawings, and from the claims.

DETAILED DESCRIPTION OF THE IMPLEMENTATIONS

Hereinafter, a refrigerator according to an implementation will be described in detail with reference to the accompanying drawings.

Figure 1:
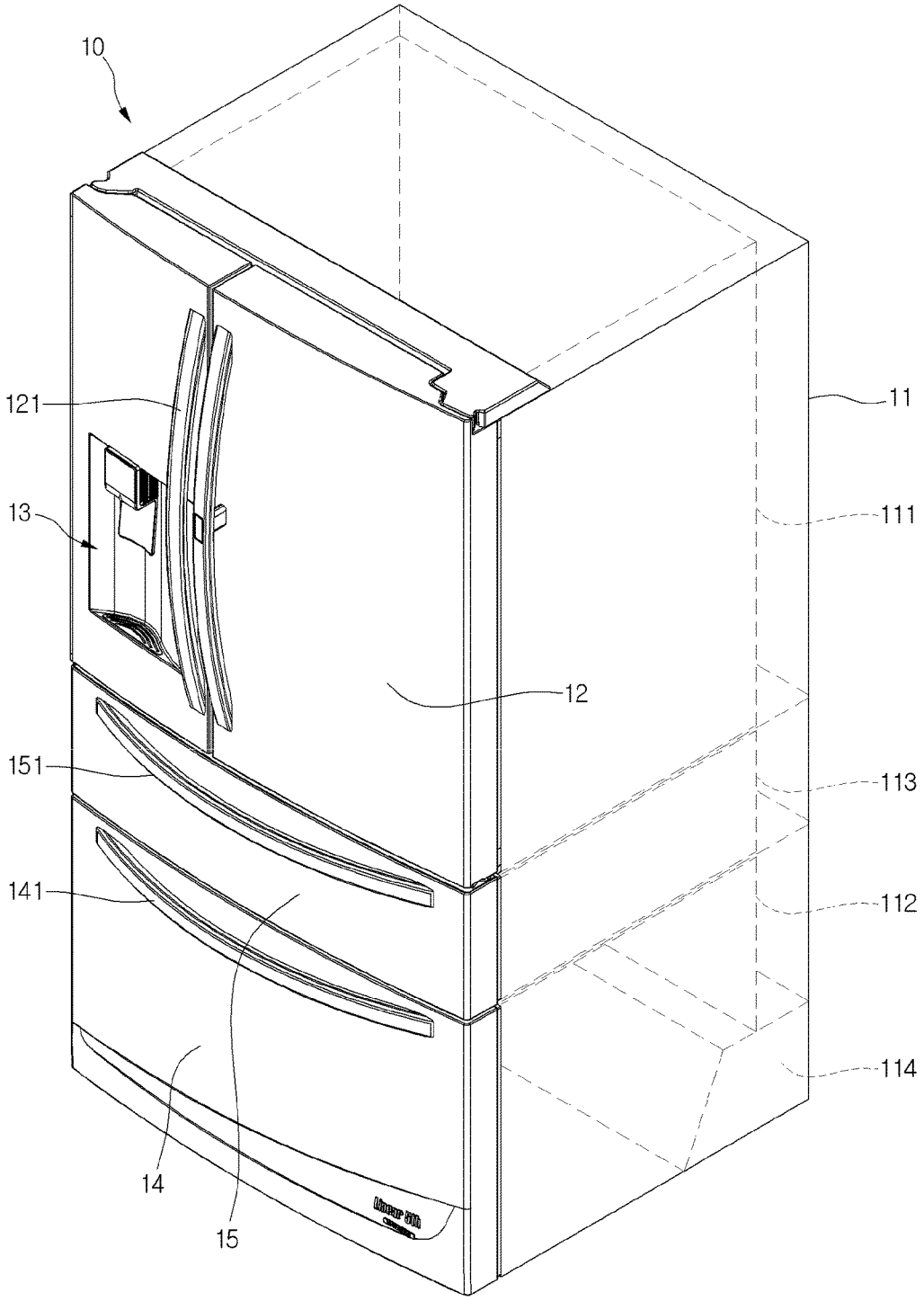
FIG. 1 is a perspective view illustrating an example refrigerator according to an implementation.

Referring to FIG. 1, a refrigerator 10 according to one implementation includes a cabinet 11 that defines an exterior of the refrigerator 10 and includes a storage compartment therein and a door for opening/closing the storage compartment.

In detail, the storage compartment provided in the cabinet 11 may include a refrigerating compartment 111, a freezing compartment 112, and a utility compartment 113.

The utility compartment 113 may be a separate storage space according to an implementation. Also, the utility compartment 113 may be maintained at a temperature of the refrigerating or freezing compartment according to use thereof.

Also, as illustrated in FIG. 1, the refrigerating compartment 111 may be defined in the uppermost portion of the cabinet 11, and the freezing compartment 112 may be defined in the lowermost portion of the cabinet 11. The utility compartment may be defined between the refrigerating compartment 111 and the freezing compartment 112. However, the present disclosure is not limited thereto. For example, the refrigerating compartment 111 and the freezing compartment 112 may be parallely disposed on left and right sides of the cabinet 11, and the utility compartment 113 may be independently provided at an intermediate portion of the refrigerating compartment 111 or the freezing compartment 112. Here, the utility compartment 113 may have a drawer-type or pantry-type structure. That is, a separate storage space may be provided in addition to the refrigerating compartment and the freezing compartment. Here, the separate storage space may be used as one of a freezing space or a refrigerating space.

A refrigerating compartment door 12 may be disposed on a front surface of the refrigerating compartment 111, and a freezing compartment door 14 may be disposed on a front surface of the freezing compartment 112. Also, a utility compartment door 15 may be disposed on a front surface of the utility compartment 113. Also, handles 121, 141, and 151 may be disposed on front surfaces of the doors, respectively.

In detail, the refrigerating compartment door 12 may be provided with a pair of rotatable doors, so call, a French door type. Also, each of the freezing compartment door 14 and the utility door 15 may be provided with a drawer type. Also, a dispenser 13 for dispensing ice or water may be disposed in one of the pair of rotatable doors that make up the refrigerating compartment door 12. Also, an ice making device may be disposed in a back surface of the door, in which the dispenser 13 is provided, or in the refrigerating compartment 111. A space 114 may represent a mechanical room in which refrigeration cycle components such as a compressor and a condenser are stored.

Figure 2:
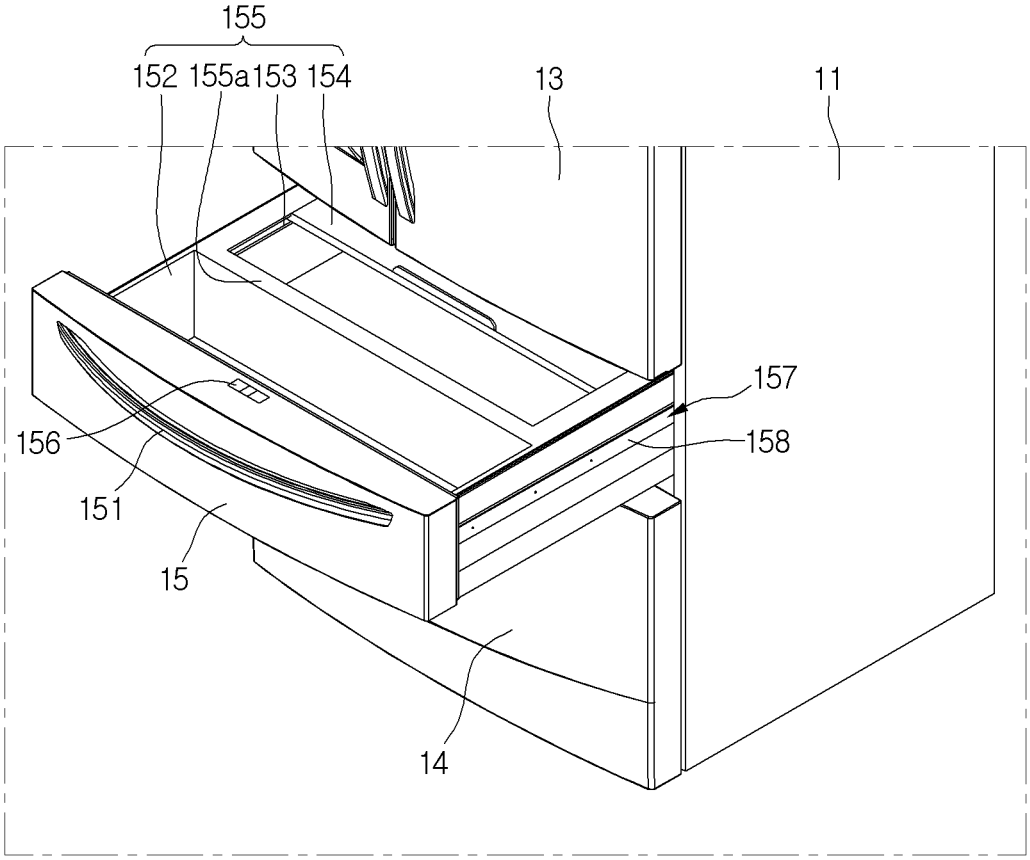
FIG. 2 is a view illustrating a state in which a reception drawer received in a utility compartment.
Figure 3:
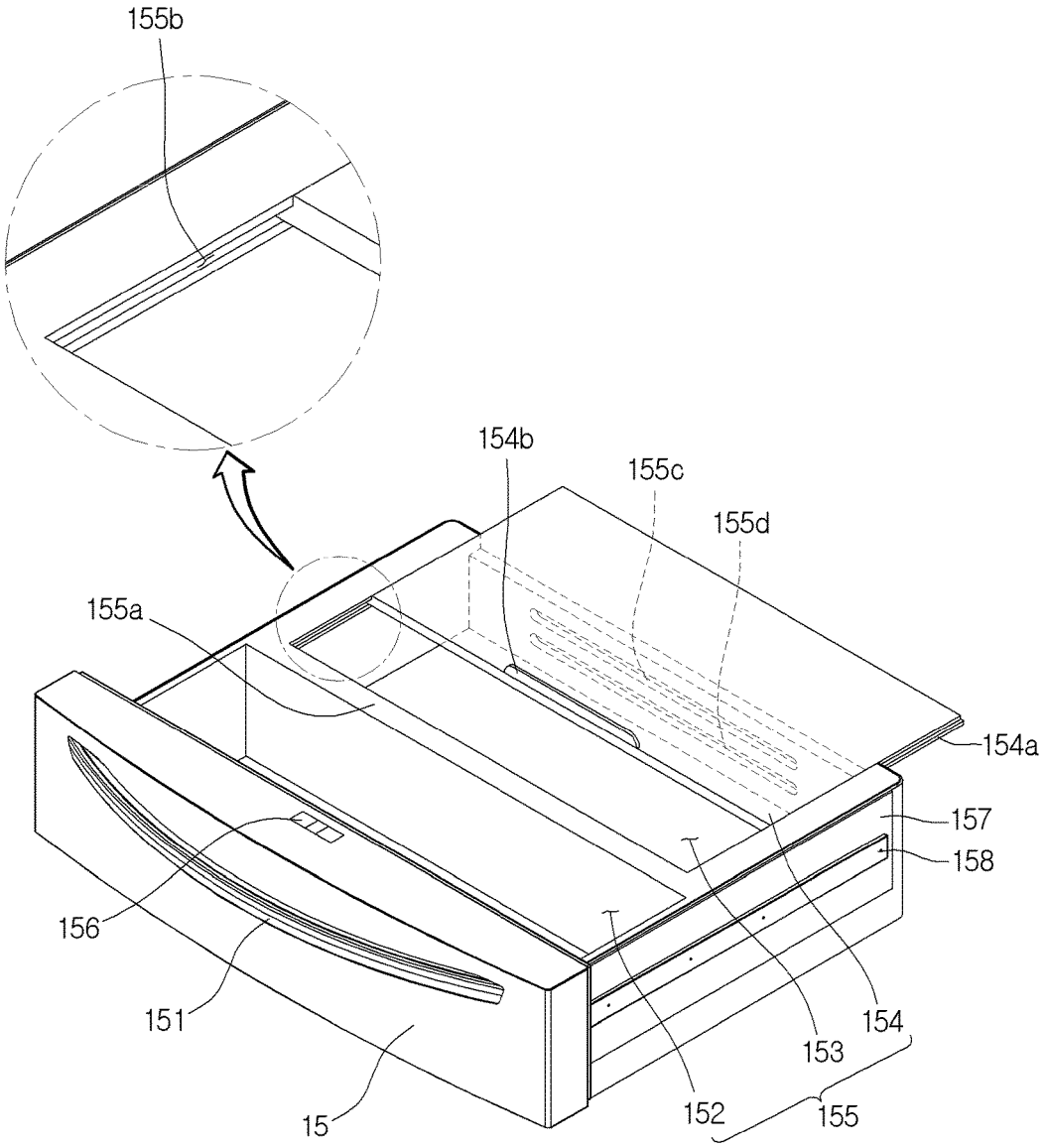
FIG. 3 is a perspective view illustrating a structure of the reception drawer received in the utility compartment.

FIG. 2 illustrates a reception drawer received in a utility compartment according to an implementation, and FIG. 3 illustrates a structure of the reception drawer received in the utility compartment according to an implementation.

Referring to FIGS. 2 and 3, the reception drawer received into the utility compartment 113 according to an implementation may include a reception door 15, a door frame 157 horizontally extending from both ends of a back surface of the reception door 15, and a reception box 155 seated on the door frame 157.

The reception box 155 may be partitioned into a refrigerating space 152 and a freezing space 153 by a partition wall 155*a*. The refrigerating space 152 may be defined at a front side of the freezing space 153. Also, an opened top surface of the freezing space 153 may be covered by a cover member 154 that is formed of a transparent material. In detail, the cover member 154 may be formed of tempered glass or transparent plastic having a thermal insulation function. Also, a slide groove 155*b* may be recessed in forward and backward directions in each of both surfaces of front end of the freezing space 153. A slide rib 154*a* may protrude from each of both surface of the cover member 154. Also, the slide rib 154*a* may be inserted into the slide groove 155*b*, and thus the cover member 154 may slidably move in forward and backward directions. Also, since the cover member 154 slidably moves in the forward and backward directions, the upper opening may be selectively opened. Also, a handle 154*b* protruding from or recessed into a top surface of a front end of the cover member 154.

Alternatively, the cover member 154 may be coupled to the reception box 155 so that the front end of the cover member 154 is vertically rotatable by using a rear end thereof as a rotation center. That is, the rear end of the cover member 154 may be rotatably coupled to an upper end of a rear surface of the reception box 155. With the above-described structure, the reception box 155 may be maximally withdrawn from the utility compartment 113, and then the handle 154*b* of the cover member grasped and lifted to access foods received in the freezing space 153.

Also, a cool air discharge hole 155*c* and a cool air collection hole 155*d* may be defined in the back surface of the reception box 155 that corresponds to a rear surface of the freezing space 153 to communicate with a sub evaporation chamber (see reference number 113*a* of FIG. 6) that will be described later.

Also, the handle 151 may be disposed on a front surface of the reception door 15, and a control panel 156 may be disposed on a top surface of the reception door 15. The control panel 156 may include a set button for setting a temperature of each of the refrigerating space 152 and the freezing space 153 and a display part for displaying the temperature of each of the refrigerating space 152 and the freezing space 153. Also, a slide rail 158 may be disposed on an outer surface of the door frame 157, and a rail guide (see reference numeral 113*b* of FIG. 4) may be disposed on an inner sidewall of the utility compartment 113. Thus, the reception drawer may be inserted into or withdrawn from the utility compartment 113. Here, like the utility compartment 113, the reception drawer including the slide rail on each of both side surfaces thereof may be withdrawably mounted in the freezing compartment 112. Also, a rail guide (see reference numeral 112*b* of FIG. 4) may be disposed on each of both side surfaces of the freezing compartment 112, and thus, the reception drawer may slidably move in the forward and backward directions.

The reception box 155 defining the freezing space 153 may have a wall thickness, i.e., an insulation thickness, greater than that of the refrigerating space 152 to prevent the refrigerating space 152 from being overcooled by the freezing space 153.

Figure 4:
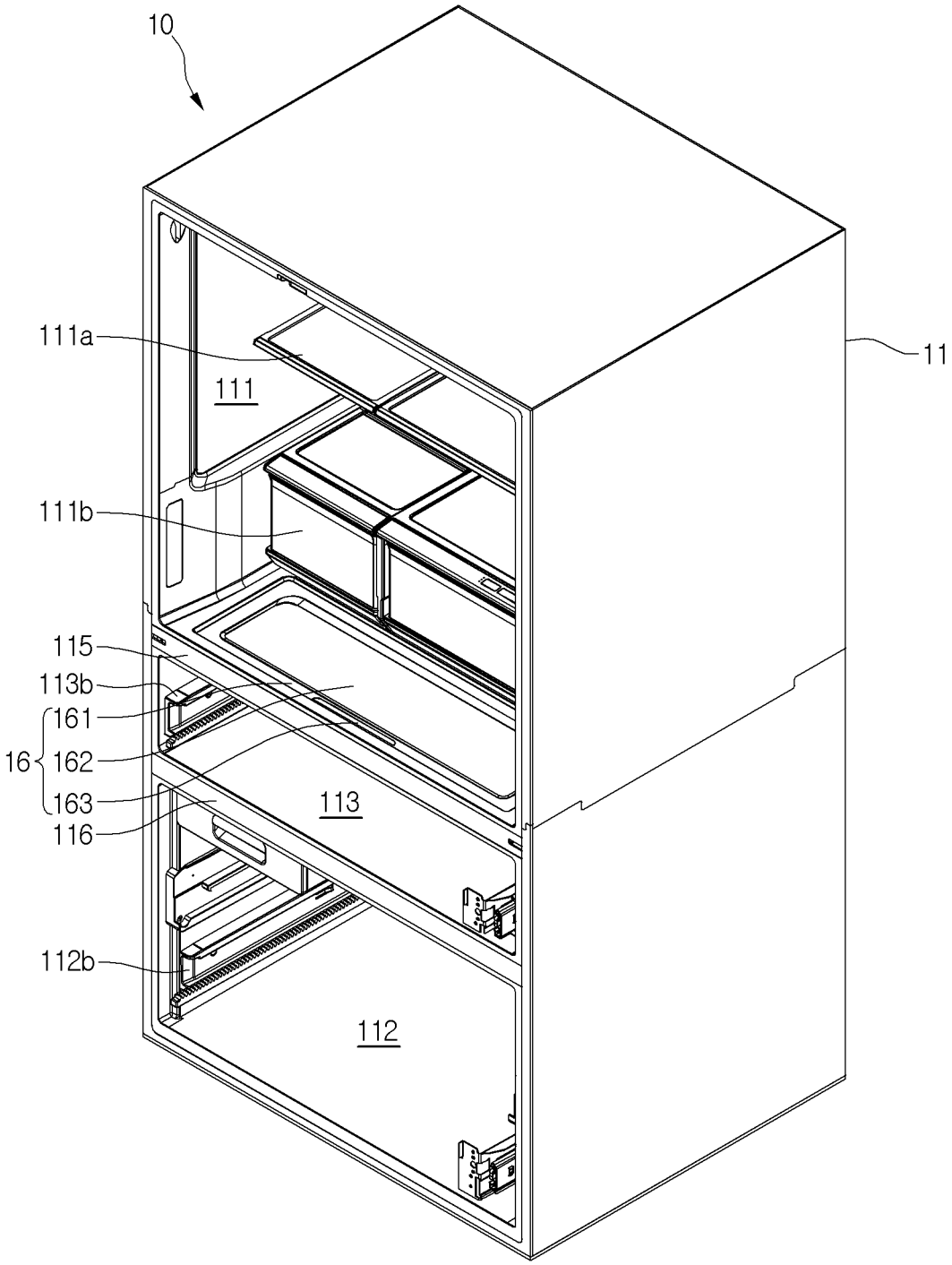
FIGS. 4 and 5 are perspective views illustrating an inner structure of a refrigerator cabinet including an access cover.
Figure 5:
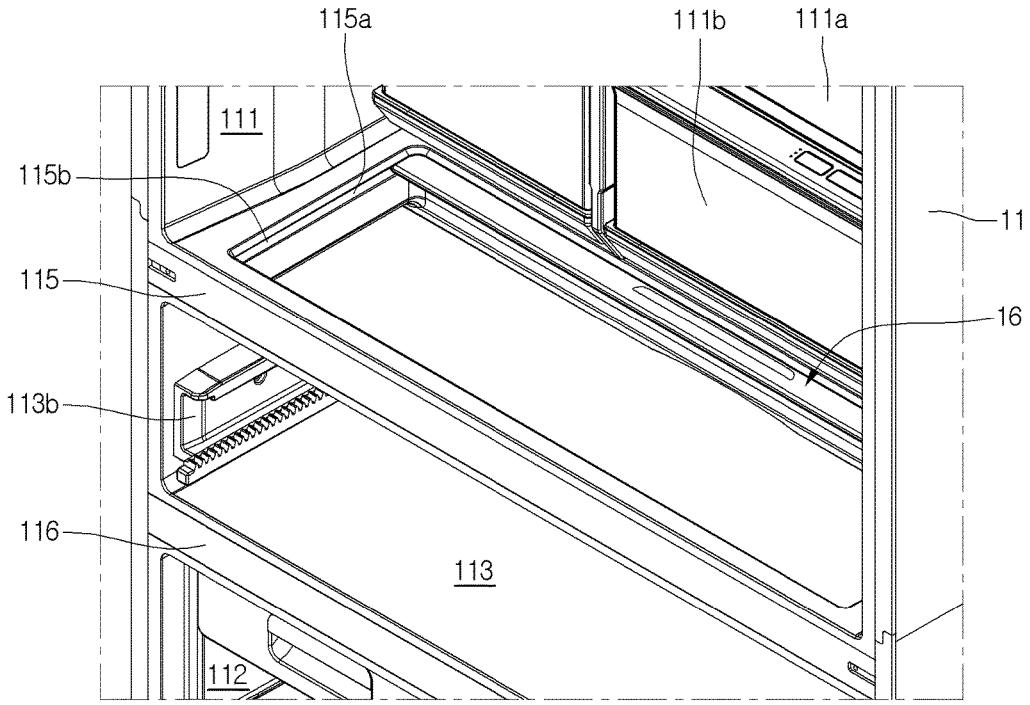

FIGS. 4 and 5 illustrate an inner structure of a refrigerator cabinet including an access cover according to an implementation.

Referring to FIG. 4, the cabinet 11 of the refrigerator 10 may include the refrigerating compartment 111, the freezing compartment 112, and the utility compartment 113 as described above. Also, the refrigerating compartment 111 may be disposed adjacent to an upper portion of the utility compartment 113, and the refrigerating compartment 111 and the utility compartment 113 may be partitioned by a first mullion 115. Also, the freezing compartment 112 may be disposed adjacent to a lower portion of the utility compartment 113, and the freezing compartment 112 and the utility compartment 113 may be partitioned by a second mullion 116.

A plurality of shelves may be vertically disposed in the refrigerating compartment 111 to place foods or containers thereon. Also, at least one storage boxes 111*b* for receiving foods may be disposed in the refrigerating compartment 111.

An access hole (see reference numeral 115*a* of FIG. 5) may be defined in a front portion of the first mullion 115. The access hole 115*a* may be selectively opened or closed by the access cover 16. Also, the storage boxes 111*b* may be disposed on a top surface of the first mullion 115 that corresponds to a rear side of the access hole 115*a* so that the user takes foods stored in the utility compartment 113 out or takes foods in the utility compartment 113 through the access hole 115*a*.

In detail, the access hole 115*a* may extend by a length corresponding to a width of the first mullion 115 and thus have a predetermined width in a rear direction of the refrigerating compartment 111. The width of the access hole 115*a* in the forward and backward directions may be equal to or less than that of the refrigerating space 152 of the reception box 155 in the forward and backward directions. Also, the width or length of the access hole 115*a* in left and right directions may be equal to or less than that of the refrigerating space 152 of the reception box 155 in left and right directions.

Also, the access cover 16 may be formed of a transparent material that allows visual inspection of contents received in the refrigerating space 152 of the reception box 155. Here, the access cover 16 may be formed of a material that does not have the insulation function, unlike the cover member 154. This can be enabled because the refrigerating compartment and the refrigerating space 152 may be heat-exchanged with each other by thermal conduction through the access cover 16 so that the refrigerating space 152 can be maintained at the refrigerating temperature.

In detail, when the refrigerating compartment 111 is maintained at the refrigerating temperature, the refrigerating space 152 may also be maintained at the refrigerating temperature by the thermal conduction through the access cover 16. In a state where the access cover 16 moves backward to open the access hole 115*a*, the cool air within the refrigerating compartment 111 may be transferred into the refrigerating space 152 by convection of the cool air.

The access cover 16 may include a cover body 161 defining an edge region, a glass panel 162 disposed inside the cover body 161, and a handle 163 disposed on a top surface of a front end of the cover body 161. The access cover 16 does not have to be formed of the glass material. Thus, the access cover 16 may be formed of a transparent plastic material. For example, the access cover 16 may be provided as a panel formed of a transparent plastic material, of which an edge portion is coated with a material having an opaque color.

In detail, a sliding groove 115*b* may be defined in an edge of each of both side surfaces of the access hole 115*a*, and an edge of each of both side surfaces of the access cover 16 may be inserted into the sliding groove 115*b*. As a result, the access cover 16 may slidably move in the forward and backward directions to selectively open the access hole 115*a*. Also, a cover accommodation groove (see reference numeral 115*c* of FIG. 6) may be defined inside the first mullion 115 to accommodate the access cover 16 that is slid backward.

Alternatively, like the cover member 154, the access cover 16 may be rotatably coupled to the first mullion 115. That is, a rear end of the access cover 16 may be rotatably coupled to the first mullion 115, and the user may grasp and lift the handle 163 of the access cover 16. Then, the foods stored in the refrigerating space 152 of the reception box 155 may be taken out, or foods may be taken into the refrigerating space 152 of the reception box 155.

Figure 6:
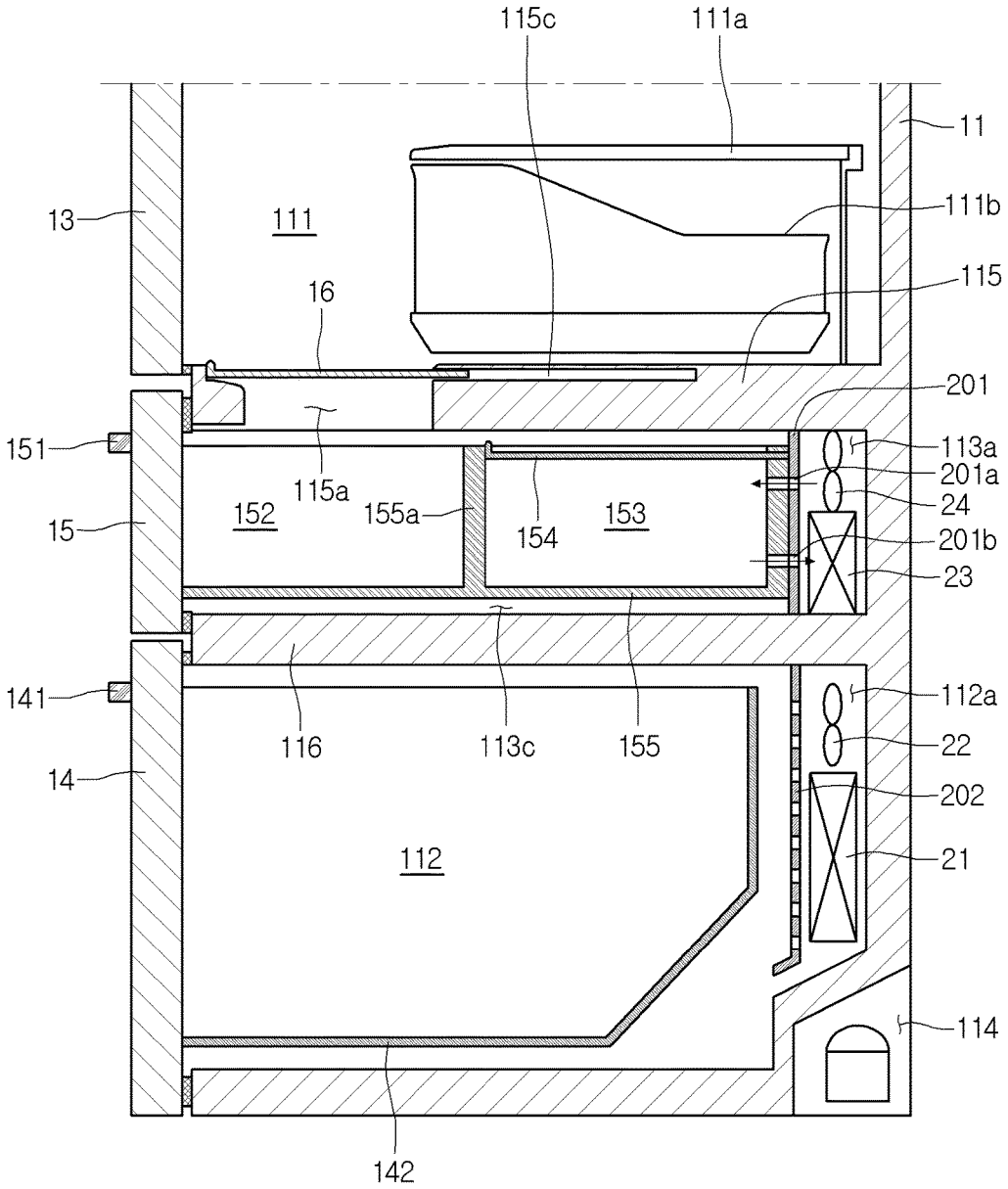
FIG. 6 is a cross-sectional view of the refrigerator of FIG. 1.

FIG. 6 is a cross-sectional view of the refrigerator according to an implementation.

Referring to FIG. 6, the utility compartment 113 may be partitioned into two spaces by a cool air grille 201. Here, the front space 113*c* may be a space for accommodating the reception box 155, and the rear space may be a space for defining the sub evaporation chamber 113*a*. A sub evaporator 23 and a sub fan 24 may be disposed in the sub evaporation chamber 113*a* to independently cool the utility compartment 113.

In detail, a cool air discharge hole 201*a* and a cool air collection hole 201*b* may be defined in the cool air grille 201. The cool air discharge hole 201*a* and the cool air collection hole 201*b* may be closely attached to the cool air discharge hole 155*c* and the cool air collection hole 155*d*, which are defined in the rear surface of the reception box 155, respectively. Thus, the cool air within the sub evaporation chamber 113*a* may communicate with only the freezing space 153 of the reception box 155 through the cool air discharge hole 115*c* and the cool air collection hole 155*d*. That is, the freezing space 153 may be maintained at the freezing temperature by the cool air supplied from the sub evaporation chamber 113*a*. Also, the cool air within the sub evaporation chamber 113*a* may be discharged into the front space 113*c* of the cool air grille 201 only when the reception door 15 moves forward so that the rear surface of the reception box 155 is separated from the cool air grille 201.

Also, in the state where the reception door 15 is closely attached to the front surface of the cabinet 11, the access hole 115*a* defined in the first mullion 115 may be defined in an upper side of the refrigerating space 152 of the reception box 155. Also, the access hole 115*a* may be closed by the access cover 16, or the access cover 16 may be retreated to open the access hole 115*a*. If the access hole 115*a* is closed by the access cover 16, the cool air within the refrigerating compartment 111 may be transferred into the refrigerating space 152 by the thermal conduction. On the other hand, if the access hole 115*a* is opened, the cool air within the refrigerating compartment 111 may be directly transferred into the refrigerating space 152. Here, since the opened top surface of the freezing compartment is maintained in the closed state by the cover member 154, the cool air within the refrigerating compartment 111 may not be transferred into the freezing compartment 153, and also, the cool air within the freezing space 153 may not be transferred into the refrigerating space 152 or the freezing compartment 111.

Also, the cover member 154 may slidably move in the forward and backward directions in only the state where the reception box 155 is withdrawn to open the freezing space 153. If the cover member 154 slidably moves in the backward direction of the reception box 155 to close the reception door 15 in the state where the freezing space 153 is opened, a rear end of the cover member 154 that protrudes backward from the rear surface of the reception box 155 may be in contact with the cool air grille 201. In this state, when the reception box 155 is inserted, the cover member 154 may stay put, and only the reception box 155 may move backward until the reception box 155 is closely attached to the cool air grille 201. In this process, the freezing space 153 may be automatically closed by the cover member 154. Thus, in the state where the reception door 15 is fully closed, the freezing space 153 may be always maintained in the closed sate by the cover member 154.

As described above, since the cool air supplied into the freezing space 153 is not transferred into the refrigerating space 152 by the cover member 154, and the insulation wall defining the freezing space 153 has a thickness greater than that that of the refrigerating space 152, overcooling of the refrigerating space 152 due to the heat exchange with the cool air may be minimized.

The freezing compartment drawer 142 may be mounted on the rear surface of the freezing compartment door 14. As described above, the freezing compartment 112 may have a structure that accommodates a reception member having the drawer shape like the utility compartment 113. Also, the cool air grille 202 may be disposed at a rear side of the freezing compartment 112, and a main evaporation chamber 112*a* may be defined in a rear space of the cool air grille 202. Also, a main evaporator 21 and a main fan 22 may be disposed in the main evaporation chamber 112*a*.

Here, in addition to the structure in which the independent sub evaporation chamber 113 *a* is defined in the rear side of the utility compartment 113, a structure in which cool air within the main evaporation chamber 112 *a* is transferred into the freezing space 153 of the reception box 155 may be allowable. Then, since it is unnecessary to provide the sub evaporator 23 and the sub fan 24, the manufacturing costs may be reduced.

The refrigerating compartment 111 may be defined as a first storage compartment, the utility compartment 113 may be defined as a second storage compartment, and the freezing compartment 112 may be defined as a third storage compartment. Also, each of the main evaporation chamber 112*a* and the sub evaporation chamber 113*a* may be defined as a cooling chamber in which the evaporator is disposed.

According to the refrigerator including the above-described features, the separate storage compartment that is separated from the refrigerating compartment and the freezing compartment may be defined in the refrigerator body, and the reception box received in the storage compartment may be partitioned into the refrigerating compartment and the freezing compartment. Also, since the user receives the chilled or frozen foods in one storage space, the user's convenience may be improved.

Also, foods that are frequently used such as side dishes may be stored in the refrigerating space provided in the separate storage space, or foods that are consumed for a short time and have to be stored in the frozen state may be stored in the freezing space provided in the separate storage space. As a result, since it wouldn't be required to open or close the refrigerating compartment or the freezing compartment which have a relatively large size, the loss of the cool air may be minimized, and also, the power consumption may be minimized.

Also, the cool air hole may be defined in the mullion that partitions the refrigerating compartment from the utility compartment, and the cool air hole may be selectively opened or closed by the transparent access cover. Thus, when the user opens the refrigerating compartment, a portion of the contents received in the utility compartment may be confirmed by the user. In addition, since the access cover is opened without withdrawing the drawer provided in the utility compartment to take the foods, which are received in the refrigerating space of the utility compartment, out, the user's convenience may be improved.

Also, when the access cover is opened to utilize the utility compartment, the cool air within the utility compartment may flow toward the refrigerating compartment, and a small amount of cool air may leak to the outside of the refrigerator to reduce the loss of the cool air.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet defining a first storage compartment and a second storage compartment that is positioned vertically below the first storage compartment;

a first mullion that partitions the first storage compartment from the second storage compartment, the first mullion defining an access hole that allows fluid communication between the first storage compartment and the second storage compartment;

an access cover configured to open or close the access hole;

a reception drawer configured to be received into the second storage compartment and comprising:

a reception door configured to open and close the second storage compartment, and a reception box provided at a rear surface of the reception door;

a cover member configured to cover at least a portion of a top surface of the reception box; and a first cooling chamber defined at a rear side of the second storage compartment and configured to supply cool air into the second storage compartment, wherein the reception box comprises:

an insulation wall that defines an exterior of the reception box, a refrigerating space defined inside the insulation wall, a freezing space defined inside the insulation wall, the freezing space being defined at a rear side of the refrigerating space, and a partition wall that partitions the refrigerating space from the freezing space, wherein the reception box is configured to, when the reception door is in a closed position, allow fluid communication between the freezing space and the first cooling chamber.

2. The refrigerator according to claim 1, wherein the access hole is positioned to correspond to the refrigerating space of the reception box when the reception door is in the closed position.

3. The refrigerator according to claim 1, wherein the cover member is configured to cover a top surface of the freezing space of the reception box.

4. The refrigerator according to claim 3, wherein the cover member is slidably coupled to an upper end of the reception box.

5. The refrigerator according to claim 3, wherein the cover member is rotatably coupled to an upper end of a rear surface of the reception box.

6. The refrigerator according to claim 1, wherein the insulation wall comprises:

a first insulation wall defining the freezing space; and a second insulation wall defining the refrigerating space, wherein the first insulation wall has a thickness greater than a thickness of the second insulation wall.

7. The refrigerator according to claim 1, further comprising a first cool air grille that partitions the second storage compartment from the first cooling chamber, wherein a cool air discharge hole and a cooling air collection hole through which the cool air passes are respectively defined in the first cooling grille.

8. The refrigerator according to claim 7, wherein the reception drawer is configured such that, when the reception door is in a fully closed position, a rear surface of the insulation wall defining the freezing space contacts the first cool air grille, wherein a cool air discharge hole and a cool air collection hole are respectively defined in the rear surface of the insulation wall, and wherein the cool air discharge hole and the cool air collection hole of the insulation wall are in fluidic communication with the cool air discharge hole and the cool air collection hole of the first cool air grille, respectively.

9. The refrigerator according to claim 1, further comprising a first evaporator and a first cooling fan that are disposed in the first cooling chamber.

10. The refrigerator according to claim 1, further comprising:

a third storage compartment defined below the second storage compartment;

a second mullion that partitions the second storage compartment from the third storage compartment;

a second cooling chamber defined at a rear side of the third storage compartment;

a second cool air grille that partitions the third storage compartment from the second cooling chamber;

a reception member accommodated in the third storage compartment; and a second evaporator and a second cooling fan that are disposed in the second cooling chamber.

11. The refrigerator according to claim 10, further comprising a first cool air grille that partitions the second storage compartment from the first cooling chamber, wherein a cool air discharge hole and a cooling air collection hole through which the cool air passes are respectively defined in the first cooling grille, wherein the second mullion defines a communication hole at a position corresponding to a top surface of the second cooling chamber, the communication hole allowing fluidic communication between the first and second cooling chambers, wherein cool air in the second cooling chamber is supplied into the first cooling chamber through the communication hole, and wherein the cool air supplied into the first cooling chamber is supplied into the freezing space of the reception box through the first cool air grille.

12. The refrigerator according to claim 10, wherein the first storage compartment comprises a refrigerating compartment, and the third storage compartment comprises a freezing compartment.

13. The refrigerator according to claim 12, wherein the second storage compartment comprises an additional refrigerating compartment or an additional freezing compartment.

14. A refrigerator comprising:

a cabinet;

a first storage compartment defined at an upper portion in the cabinet;

a first door configured to open and close the first storage compartment;

a second storage compartment defined at a lower portion in the cabinet;

a second door configured to open and close the second storage compartment;

an insulation wall horizontally disposed between the first storage compartment and the second compartment and configured to maintain the first and second compartments in different temperatures from each other;

a food passing hole defined in the insulation wall and located at a front portion of the insulation wall, the second storage compartment being configured to communicate with the first storage compartment through the food passing hole; and a transparent access cover configured to slide into the insulation wall, wherein the food passing hole is selectively opened based on a horizontal movement of the transparent access cover into the insulation wall.

15. The refrigerator according to claim 14, further comprising at least one storage box disposed above an upper surface of the insulation wall, wherein the at least one storage box is located rearward of the food passing hole above the upper surface of the insulation wall.

16. The refrigerator according to claim 14, wherein the insulation wall defines a cover accommodation groove inside the insulation wall, the cover accommodation groove being configured to receive the transparent access cover based on the transparent access cover horizontally sliding into the insulation wall to thereby open the food passing hole.

17. The refrigerator according to claim 14, further comprising a reception box located at a rear surface of the second door and configured to be received in the second storage compartment.

18. The refrigerator according to claim 14, wherein the insulation wall surrounds an entire perimeter of the food passing hole.

19. The refrigerator according to claim 16, wherein the cover accommodation groove is located rearward of the food passing hole, wherein, based on the transparent access cover closing the food passing hole, a majority of the access cover is located outside the cover accommodation groove, and wherein, based on the transparent access cover opening the food passing hole, the majority of the access cover is located in the cover accommodation groove.

* * * * *